United States Patent [19]

Lauterbach

[11] Patent Number: 4,480,572

[45] Date of Patent: Nov. 6, 1984

[54] TILLER TENDER

[76] Inventor: John Lauterbach, 1303 Shadberry La., New Port Richey, Fla.

[21] Appl. No.: 419,527

[22] Filed: Sep. 17, 1982

[51] Int. Cl.[3] ..... B63H 25/52

[52] U.S. Cl. ..... 114/162; 114/218

[58] Field of Search ..... 114/144 R, 170, 172, 114/162, 218, 101

[56] References Cited

U.S. PATENT DOCUMENTS

| | | | |
|---|---|---|---|
| 279,985 | 6/1883 | Sharrett | 114/101 |
| 1,401,290 | 12/1921 | Taylor | 114/170 |
| 2,103,630 | 12/1937 | Morin | 114/101 |
| 2,615,418 | 10/1952 | Aspenleiter | 114/162 |
| 2,870,733 | 1/1959 | Winther | 114/218 |
| 3,125,978 | 3/1964 | Faul | 114/218 |
| 3,279,410 | 10/1966 | Young | 114/172 |
| 4,241,684 | 12/1980 | Davis | 114/172 |

*Primary Examiner*—Trygve M. Blix
*Assistant Examiner*—Patrick W. Young
*Attorney, Agent, or Firm*—Ronald E. Smith

[57] ABSTRACT

A device that enhances the feel of a sailboat tiller when such tiller is manually attended, and that maintains any preselected position of such tiller when it is left unattended.

Novel clamping members are laterally disposed relative to one another on the transom portion of a sailboat, and releasably secure opposite ends of an elongate, elastomeric cord such that the cord lies tautly in a horizontal plane against such transom when no external force other than such clamping members is imparted thereto.

A combination wedge and roller element is fixedly secured to the underside of a conventional tiller, and either the roller or the wedge engages the cord, thereby elongating the cord, when the invention is in use. The roller element engages the cord when the tiller is attended to improve the feel of such tiller, and the wedge element engages the cord when the tiller is unattended, to thereby hold the tiller against substantial movement.

4 Claims, 7 Drawing Figures

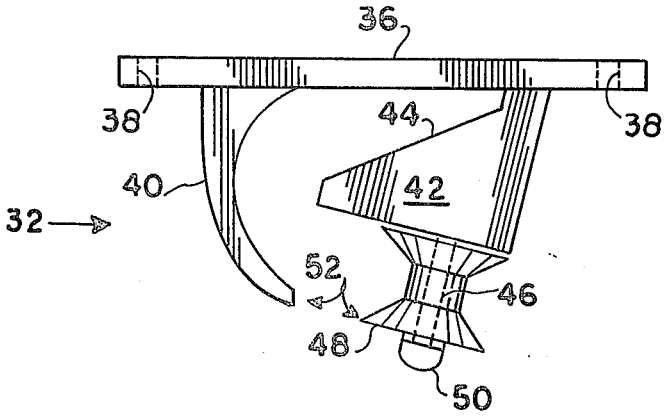
FIG_4
FIG_5
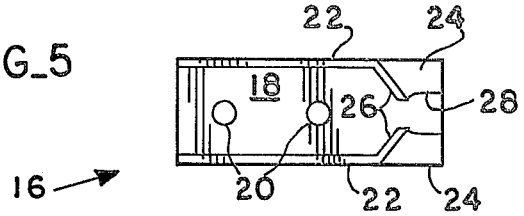
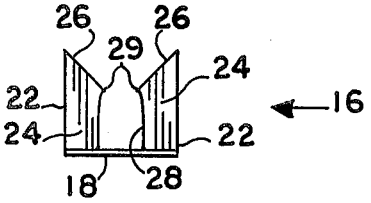
FIG_7
FIG_6
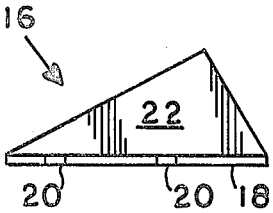

TILLER TENDER

BACKGROUND OF THE INVENTION

1. Field of the Invention

This invention relates, generally, to devices used in conjunction with sailboat or other small boat tillers to hold the same in a preselected position when such tillers are unattended, and more specifically relates to such a device that features a combinational assembly that has utility in the context of attended and unattended tillers.

2. Description of the Prior Art

A search of United States patents that was conducted prior to the filing of this disclosure found the following earlier disclosures:

| Patentee | U.S. Pat. No. | Date of Issue |
|---|---|---|
| Landgraf, Jr. | 2,237,834 | 04-08-41 |
| Young | 3,279,410 | 10-18-66 |
| Bonhard | 4,080,918 | 03-28-78 |
| Childress | 4,188,904 | 02-19-80 |
| Davis | 4,241,684 | 12-30-80 |

The field of search included Class/sub-class 114/144,170,172.

There is a need for a device that can maintain a tiller in a preselected position even when the tiller is unattended, and that can improve the feel of a tiller when it is being conventionally manned. The needed device would provide some "give" when the tiller is locked into its preselected position, to prevent undue strains on the tiller and rudder mechanisms of the boat. The needed device would install easily, and could quickly be changed from its attended to its unattended configuration, but a device of the type that is needed does not appear in the prior art.

SUMMARY OF THE INVENTION

The longstanding but heretofore unfulfilled need for a device that overcomes the limitations of earlier tiller accessories is now provided in the form of a device that holds the tiller against displacement when the same is unattended and that improves the handling of the tiller when such tiller is being manipulated.

A shock cord of elastomeric construction is mounted at its opposite ends onto the transom of a boat by uniquely formed clamping means. A wedge or "V"-shaped member is mounted onto the underside of a conventional tiller, with its open end facing forward. Thus, when it is desired to leave the tiller, the tiller is placed in its desired position, the medial portion of the shock cord is grasped, and the cord is stretched so that a portion thereof can be inserted into the wedge-shaped cavity. Upon returning to the tiller, the cord can easily be withdrawn from the wedge-shaped cavity and restored to its equilibrium position against the transom, or it can be placed in a roller means that is vertically spaced just downwardly of the wedge means. As the tiller is manipulated, the roller means will rollingly engage the major portion of the length of the shock cord, depending of course upon the turns executed by the helmsman, and such continuous engagement will improve the feel of the tiller.

It is therefore seen that the primary object of this invention is to improve tiller tending devices by providing a dual function tiller tending device.

Another important object is to provide an improved tiller tending device that can be provided to boat owners in kit form, and which is easy to assemble from such kit.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 4 is a side elevational view of the novel combinational wedge/roller member.

FIG. 5 is a top plan view of the novel cleats that secure the opposite ends of the shock cord when the invention is installed on a boat.

FIG. 6 is a side elevational view of the novel cleats.

FIG. 7 is an end view of the novel cleats.

DETAILED DESCRIPTION OF THE PREFERRED EMBODIMENT

Figure 1:
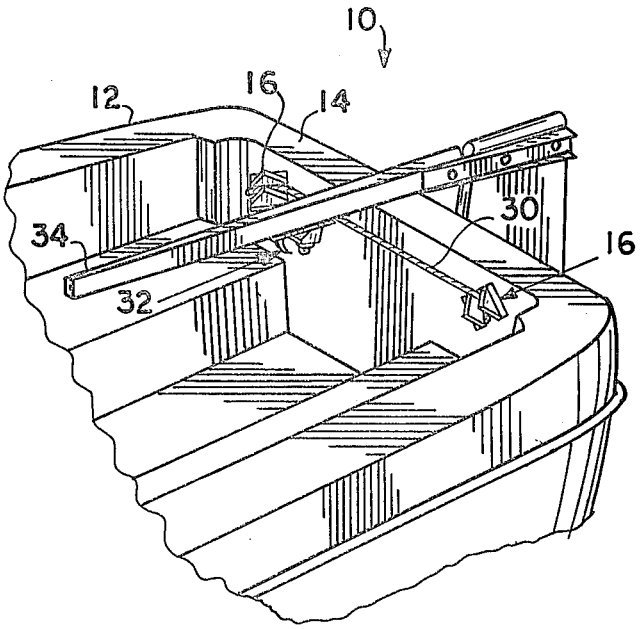
FIG. 1 is a perspective view showing the inventive structure as the same appears when installed on a boat, but with the shock cord and combinational wedging-/roller means in their disengaged state.

Referring now to the drawings, it will there be seen that an embodiment of the invention that is illustrative of the principles thereof is designated 10 as a whole.

A boat 12 is shown having a transom portion 14 upon which the novel cleats 16, 16 are secured. The cleats 16, 16 are seen in perspective in FIGS. 1–3, and are shown in isometric views in FIGS. 5–7. Each cleat 16 has a flat, rectangular bottom wall 18 having two (2) longitudinally spaced apertures 20 formed therein in coincidence with the longitudinal axis of symmetry of such bottom wall 18. Screw members, not shown, extend through such apertures 20 and fixedly secure the cleats to the transom 14. Of course, when the cleats 16, 16 are being installed, the bottom wall 18 is used as a template to mark the points at which holes will need to be drilled into the transom 14 to receive the screw members.

Each cleat 16 has triangular sidewalls 22, 22 which project upwardly from the longitudinally aligned edges of the bottom wall 18 of each cleat 16. In the preferred embodiment, as is clear from an inspection of FIG. 6, the sidewalls 22 form a 30-60-90 degree triangle.

As is perhaps best shown in FIGS. 5 and 7, each cleat 16 is provided with a transversely aligned, inclined from the vertical forward wall 24 that is bifurcated along its vertical axis of symmetry by transversely opposed bevels 26, 26 which terminate in slot 28 which extends to bottom wall 18. As best seen in FIG. 7, slot 28 is narrowed at its uppermost end as at 29, 29 by the respective terminii of bevels 26, 26.

When the invention is properly installed, the opposite ends of a shock cord, described hereinafter, are inserted into the respective slots 28, 28 of each cleat 16, 16, the bevels 26, 26 serving as a centering guide means for the needed insertion. The slot overhangs 29, 29 prevent inadvertant retraction of the shock cord ends from the respective slots 28, 28 of the cleats 16, 16. The insertion of the ends of the shock cord into the slots can be accomplished in moments.

The above-mentioned shock cord is designated in the drawings by the reference numeral 30, and is an elongate cord means of elastomeric construction. FIG. 1 shows that the cord 30 lies flat against the transom 14, in a substantially horizontal plane, when properly installed.

When it is desired to operate the boat in an entirely conventional manner, the shock cord 30 is left in the position shown in FIG. 1, and the tiller is handled in the conventional fashion.

Figure 2:
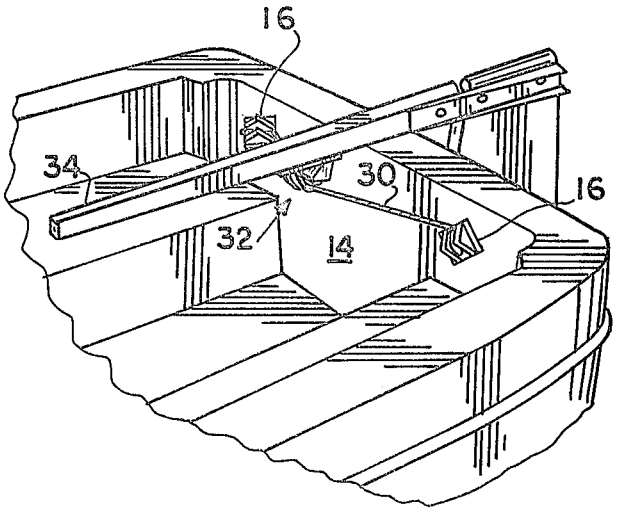
FIG. 2 is a perspective view similar to that of FIG. 1, but showing the novel shock cord disposed in rolling engagement with the novel roller means.
Figure 3:
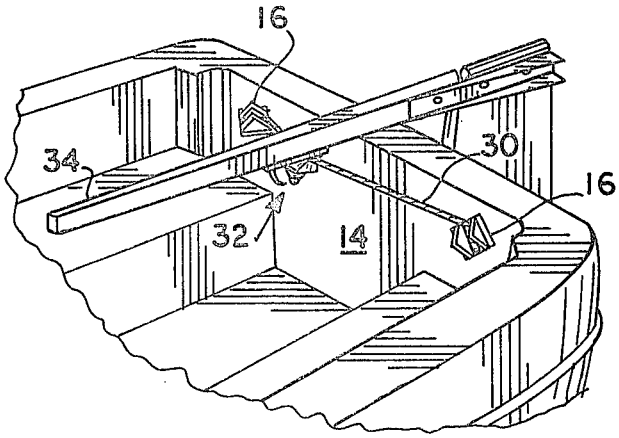
FIG. 3 is a perspective view similar to that of FIG. 1, but showing the novel shock cord disposed in wedged arrangement with the novel wedging means.

As shown in FIGS. 1–3, a novel combinational wedge/roller means, generally designated 32, is fixedly secured to the underside of a conventional tiller 34, about mid-length thereof. As perhaps best seen in FIG. 4, the combinational member 32 includes a flat, rectangular base means 36 that is apertured as at 38, 38, along its longitudinal axis of symmetry, to receive screw means, not shown, which secure the member 32 to the tiller 34. A curvilinear guard means 40 depends from the forward portion of the base 36, as shown. A flat, generally triangular in configuration wedge member 42 depends to the rearward portion of the base means 36, at an angle inclined from the vertical, and defines a forwardly opening wedge-shaped cavity 44. A post member 46, shown in phantom lines in FIG. 4, depends to the wedge member 42 at the same inclined from the vertical angle, and rotatably mounts roller member 48. A nut means 50 caps the post 46 and maintains the roller member 48 thereon.

Thus, when it is desired to leave the tiller 34 unattended for any reason, the tiller is positioned in the position in which it is to be left, and the shock cord 30 is stretched so that a portion thereof can be inserted through the opening 52 between the distal end of the guard means 40 and the roller or sheave member 48, and into the wedge-shaped cavity 44. Tightly wedging the cord 30 into such cavity 44 will secure the tiller 34 against movement so that the boat will maintain its selected course during the time that the tiller 34 is unattended.

The elastomeric cord 30 does not maintain the tiller 34 in an absolutely rigid position, due to the elasticity of the cord 30. This is highly desirable, since an overly rigid hold on the tiller could result in undue strain being placed upon it at times. The elastomeric cord 30 will "give" as needed, but its resiliency will restore it to its preselected position when the unusual stresses dissipate.

To improve the "feel" of the tiller 34, the cord 30 is placed in the groove of the sheave 48. The tautness of the cord 30 will enhance the handling of the tiller 34 as the cord 30 continuously rollingly engages the roller means 48.

The close vertical spacing of the wedge member 42 and the sheave 48 enables the helmsman to easily change the cord 30 from sheave 48 to cavity 44, or vice versa.

It will thus be seen that the objects set forth above, and those made apparent by the preceding description, are efficiently attained and since certain changes may be made in the above construction, without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, that which is claimed is:

1. An apparatus used on boats equipped with a tiller, comprising, an elongate, flexible cord means of elastomeric construction and hence extensible along its length, clamping means fixedly secured to a transom of a boat equipped with a tiller, said clamping means spaed equidistantly relative to a rudder operated by said tiller, said clamping means adapted to substantially non-releasably secure opposite ends of said cord means to said transom, a combination wedge and roller member fixedly secured to said tiller, said combination member including a roller member for transiently engaging said cord means along its extent, said combination member further including a forwardly opening wedge-shaped cavity means, said cord means alternately positionable in either said roller member or said cavity means by grasping the cord means, said cavity means forming a cavity tapering from its wide, forward cord-receiving opening to a narrow, cord-pinching rearward end.

2. The apparatus of claim 1, wherein said roller member is mounted for rotation in a substantially horizontal plane.

3. The apparatus of claim 2, wherein said roller member and said wedge-shaped cavity means are disposed in vertically stacked relation to one another.

4. The apparatus of claim 3, wherein said wedge-shaped cavity means is disposed upwardly of said roller member.

* * * * *